US005322264A

United States Patent [19]

Giambro

[11] Patent Number: 5,322,264

[45] Date of Patent: Jun. 21, 1994

[54] UTILITY BAR TOOL

[76] Inventor: Peter Giambro, 333 Victory Rd., Quincy, Mass. 02171

[21] Appl. No.: 67,235

[22] Filed: May 26, 1993

[51] Int. Cl.[5] ..... B25C 11/00

[52] U.S. Cl. ..... 254/25

[58] Field of Search ..... 254/25, 18, 28, 17, 254/131, 131.5; 81/45, 46; 7/166; 29/275, 167

[56] References Cited

U.S. PATENT DOCUMENTS

| | | | |
|---|---|---|---|
| 1,647,576 | 11/1927 | Nowka et al. | 254/25 |
| 2,457,231 | 12/1948 | Henderson | 254/25 |
| 2,471,557 | 5/1949 | Bishop | 29/275 |
| 2,896,910 | 7/1959 | Cooper et al. | 254/131 |
| 4,670,932 | 6/1987 | Williams | 254/25 |
| 5,207,126 | 5/1993 | Schaben | 254/25 |

FOREIGN PATENT DOCUMENTS

| | | | |
|---|---|---|---|
| 462934 | 7/1928 | Fed. Rep. of Germany | 254/25 |
| 500939 | 6/1930 | Fed. Rep. of Germany | 254/25 |

*Primary Examiner*—Robert C. Watson

*Attorney, Agent, or Firm*—Cesari and McKenna

[57] ABSTRACT

A hand tool consists of a single length of flat, rigid, steel bar stock bent in the nominal plane of the bar to form a long main body, an elongated head offset from one end of the main body by an orthogonal shoulder and a relatively long foot extending from the other end of the main body in a direction generally opposite to the direction of the offset. The free ends of the head and foot are provided with beveled edges which are notched to enable the head and foot to be engaged under nail heads. The tool can be used in a wide variety of prying, pulling, lifting and positioning applications.

4 Claims, 2 Drawing Sheets

UTILITY BAR TOOL

FIELD OF THE INVENTION

This invention relates to a hand tool. It relates more particularly to a multi-purpose utility bar which can perform a variety of different prying, lifting, aligning and ripping functions.

BACKGROUND OF THE INVENTION

Utility bars of the general type with which this invention is concerned have been available for many years. Such tools run the gamut from long, straight crowbars used to lever large rocks in order to move the rocks to short J-shaped pry bars commonly used to pull nails, pry shingles from roofs, etc.

More recently, there has appeared on the market a utility bar made of flat bar stock. This bar, shown generally at 10 in FIG. 5, has a strap-like body 12 which is in the order of fifteen inches long. The lower end of body 12 is terminated by a relatively short, e.g., two inch, foot 14 which joins body 12 at a heel 16 that has reverse curvature. The forward edge of foot 14 has a bevel 14*a* at its upper surface and a notch 17 is provided in that edge for grasping nails. The upper end of body 12 has a relatively sharp edge formed by a bevel 12*a* at the rear surface of body 12 and a notch 18 is provided in that edge to enable bar 10 to grasp nails at that location. Usually, the upper end segment 12*b* of body 10 is curved rearwardly as shown in FIG. 5 and a wedge-shaped opening 19 is provided in the bar just below the curve. That opening may be used to hang the tool from the wall fastener or to grasp a nail head in order to lift out a nail.

Because the prior tool 10 has a short foot 14, when the tool is used to pry out a nail using the notch 17, the edge of the foot moves along an arc with a relatively short diameter with the result that the tool actually bends the nail. Therefore, if the nail is relatively long, a full downward stroke on the tool body 12 may not suffice to pull out the nail completely. The tool must then be disengaged from the nail and reengaged therewith at the notch 18 or opening 19 in order to finish extracting the nail. This two-step nail pulling procedure can be tedious and time consuming particularly if a particular project involves removing a large number of nails.

Another disadvantage of the prior tool 10 is that its edge bevels 12*a* and 14*a* are relatively short and face away from the tool's working fulcrums at 16 and 12*b*. This sometimes makes it somewhat difficult to engage the bar edge 12*b* and 14*b* under a nail head or between objects to be pried apart.

Also, the tool 10 is not particularly good for lifting or aligning heavy objects such as wood or wall board panels, doors, kitchen cabinets and the like. This is due not only to its diminutive foot which may dig into the object, but also to the overall shape of the tool and its insufficient rigidity.

SUMMARY OF THE INVENTION

Accordingly, the present invention aims to provide an improved hand tool in the nature of a utility bar.

Another object of the invention is to provide a utility bar tool which can perform a wide variety of different functions.

A further object of the invention is to provide a hand tool of this general type which can pry, split, rip, lift and shift objects more efficiently and effectively than prior comparable tools.

Yet another object of the invention is to provide a utility bar which is relatively easy and inexpensive to manufacture.

Other objects will, in part, be obvious, and, will in part, appear hereinafter. The invention accordingly comprises the features of construction, combination of elements and arrangement of parts which will be exemplified in the following detailed description and the scope of the invention will be indicated in the claims.

Briefly, my utility bar tool is formed from a single length of rigid steel bar stock. The tool has an unusually long body. An elongated head is offset from one end of the body thereby defining a shoulder between the head and the body and a relatively long foot extends from the opposite end of the body in a direction generally opposite to the direction of the offset. Long bevels are provided at the free ends of the foot and head so that those ends have sharp edges with relatively small wedge angles. Preferably, notches are provided at those edges to enable both ends of the tool to be engaged under nail heads for nail pulling purposes.

As will be described in detail presently, the extra long, flat foot extending out from the body and the elongated head offset from the body by the shoulder enable my tool to perform many different prying, pulling, lifting and aligning functions efficiently and effectively.

BRIEF DESCRIPTION OF THE DRAWING

For a fuller understanding of the nature and objects of the invention, reference should be had to the following detailed description taken in connection with the accompanying drawing, in which.

DETAILED DESCRIPTION OF ILLUSTRATIVE EMBODIMENT

Figure 1:
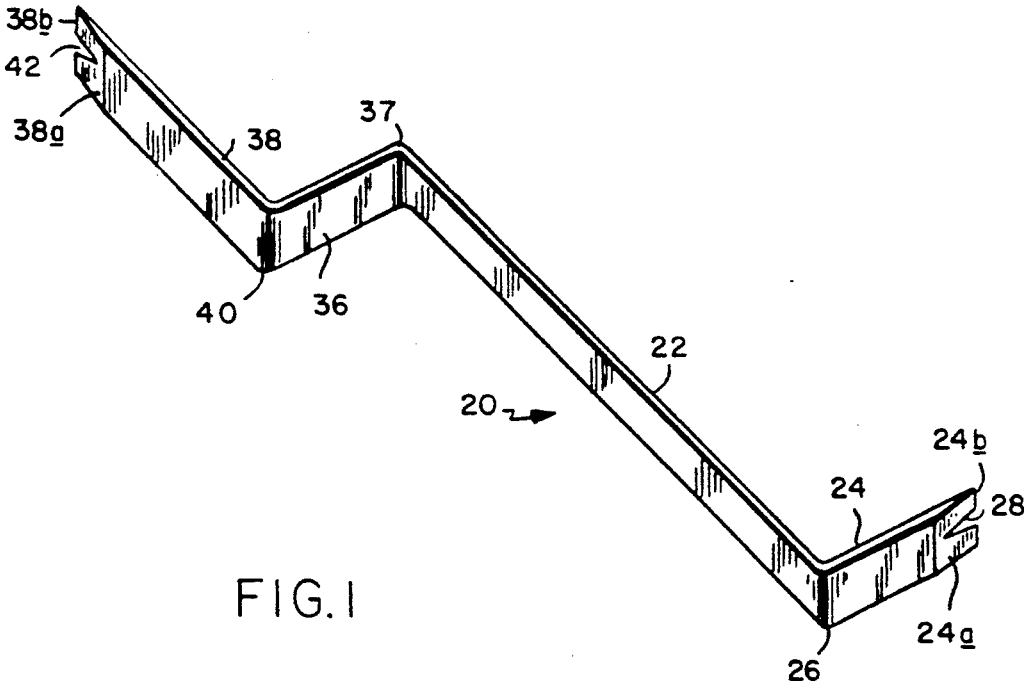
FIG. 1 is an isometric view of a utility bar tool incorporating my invention.

Referring to FIG. 1, my utility bar, shown generally at 20, is formed from a single length of flat, steel bar stock which is preferably in the order of 1½ inch wide and ¼ inch thick, making the bar quite rigid. The tool includes a long, straight main body 22 whose lower end is terminated by a flat foot 24 which extends out at a right angle to the body forming a relatively sharp outside corner or heel 26 at the boundary between the body and the foot. A relatively long, i.e., 1 inch, bevel 24*a* is provided at the free end of foot 24, preferably on the same surface of the foot that leads to heel 26. This creates a sharp edge 24*b* with a small wedge angle at the free end of the foot. Preferably also, a notch 28 extends in from edge 24*b* toward body 22 to enable foot 24 to grasp a nail by engagement under the nail head.

A shoulder 36 extends from the opposite end of main body 22 in a direction opposite to that of the foot forming an outside corner 37. Connected to the free end of the shoulder is an elongated head 38 which extends parallel to the main body 22 away from the foot 24 thus creating an outside corner 40. Thus, the head 38 is offset from body 22 by the orthogonal shoulder 36. A relatively long, i.e., 1 inch, bevel 38*a* is provided at the free end of head 38 the bevel preferably being at the same surface of the head that leads to the outside corner 40. A wedge-shaped notch 42 extends in from edge **38*b* toward the shoulder 36** to enable that end of the tool to engage and pull nails.

In a typical tool 20, body 22 may be in the order of fourteen inches long, foot 24 may be 3½ inches long, shoulder 36 may be 3 inches long and head 38 may be in the order of 4¼ inches long so that the tool has an overall length of over eighteen inches from head to foot.

Figure 2:
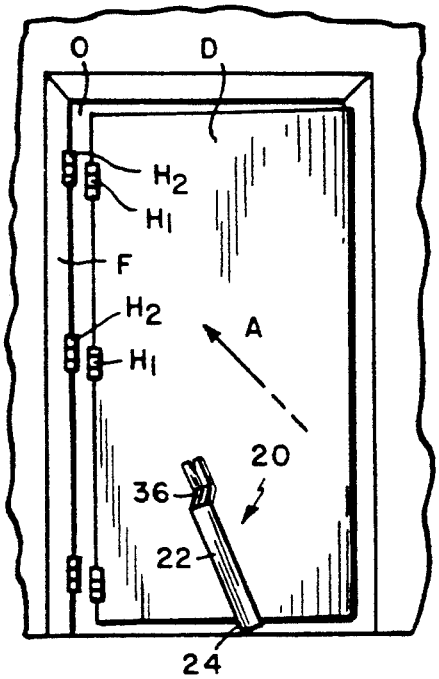
FIGS. 2 to 4 are diagrammatic views illustrating various uses for the FIG. 1 tool, and FIG. 5, already described, is an isometric view on a smaller scale of a known utility bar.

When the tool is in use, either the foot 24 or the head 38 may constitute the working end of the tool. For example, FIG. 2 illustrates how the tool may be used to lift and position a heavy door D in a door opening O to align hinge components $H_1$ on the door to mating hinge components $H_2$ mounted to the door frame F when hanging the door. In this case, foot 24 is the working end of the tool. As shown in that figure, the foot 24 of tool 20 may be slid under the door. This is facilitated by the unusually long bevel **24*a* at the end of the foot. The fact that the bevel 24*a* is at the underside of the foot also helps in this respect. If the tool is then tilted or swung to the left about the left edge of foot 24 as shown in FIG. 2**, it will lift and shift door D in the direction of the arrow A to bring the hinge components $H_1$ on the door into alignment with the corresponding hinge components $H_2$ on the door frame so that the mating hinge components can be swingably connected together by conventional hinge pins (not shown).

Of course, if the tool is swung in the opposite direction, the door D will be lifted up and shifted toward the right in FIG. 2.

The bar's extra rigidity and extra long length enable the tool to be employed in a similar fashion to lift and shift other heavy objects such as kitchen cabinets, counters, kitchen appliances, etc. The tool can also be used to pry up thresholds and shoes in doorways, to remove wood or metal headers from wall openings, to separate nailed-together or laminated boards and to perform a variety of other similar functions. Again, the long reverse bevel **24*a* at the end of foot 24** facilitates inserting the tool foot under the object to be lifted or between the objects being pried apart.

A worker can also use tool 20 to lift and carry a large heavy door or other panel-like object. After sliding the foot of the tool under the door as shown in FIG. 2, the worker can grasp the tool at shoulder 36 with one hand and lift, while holding the side edge of the door with his other hand, and thus carry the door from one place to another. Due to the unusually long length of the tool's body 22, the worker can lift the door without having to stoop to any great extent, and in view of the unusually long length of foot 24, there is little chance of the door becoming disengaged from the tool in transit.

Figure 5:
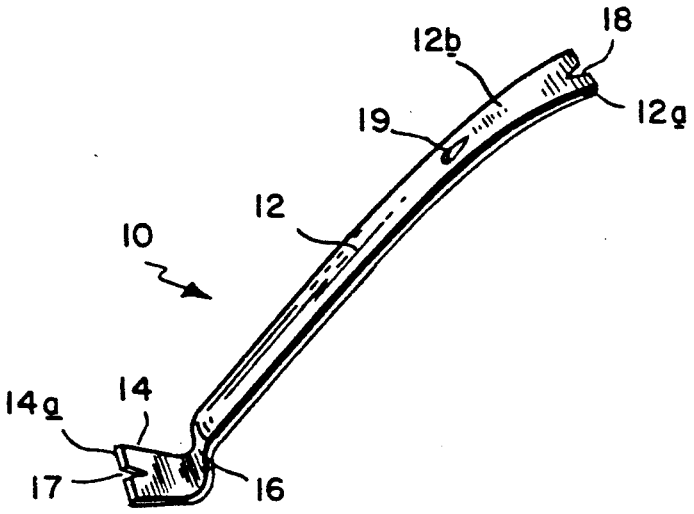
FIG. 5 PRIOR ART

For the same reasons stated above, tool 20 can be used to pull out nails as large as sixteen penny. For this, the edge **24*b* of the tool foot 24 is engaged under the head of the nail to be removed so that the nail is received in slot 28. Then the tool is swung about its heel 26. Because of the long lever arm provided by the main body 22 and head 38, a considerable pulling force can be exerted on the nail. Moreover, due to the long length of the foot 24, that force is exerted parallel to the nail for the most part. Therefore, the nail is not bent while being pulled to the extent that it is by a conventional claw hammer or pulling tool such as depicted as in FIG. 5. Consequently, a single downward motion of the tool about the heel 26** usually suffices to extract the nail.

Figure 3:
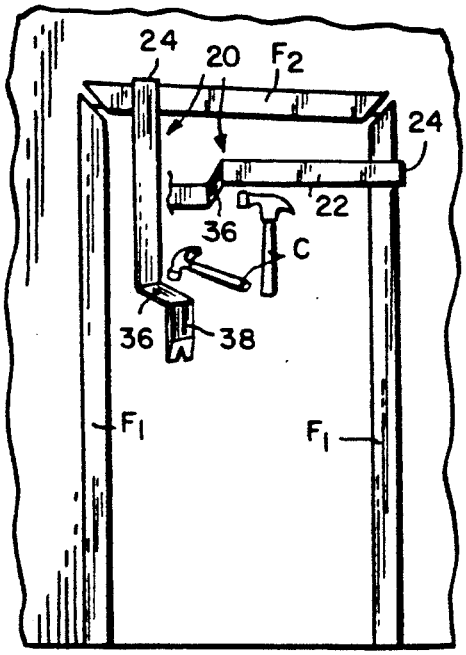

Refer now to FIG. 3 which illustrates how tool 20 may be used to facilitate the proper installations of frames F around wall openings. The usual way to plum the frames F vertically and horizontally using a level is to tap on the edge of the frame adjacent to the wall with a hammer. However, that can cause dents and other damage to the wall and to the frame. If one has tool 20, the tool can be positioned as shown in FIG. 3 with its foot 24 engaging the edge of a frame F. Then, blows from a hammer C may be applied to the tool's shoulder 36 which is located well away from the wall. The resulting force on the tool will be transmitted to the frame F to shift this frame until it is squared up. Since the foot 24 is relatively wide, the force on the frame is distributed over a relatively large area so that the tool does not tend to dent or otherwise deform the frame edge.

Figure 4:
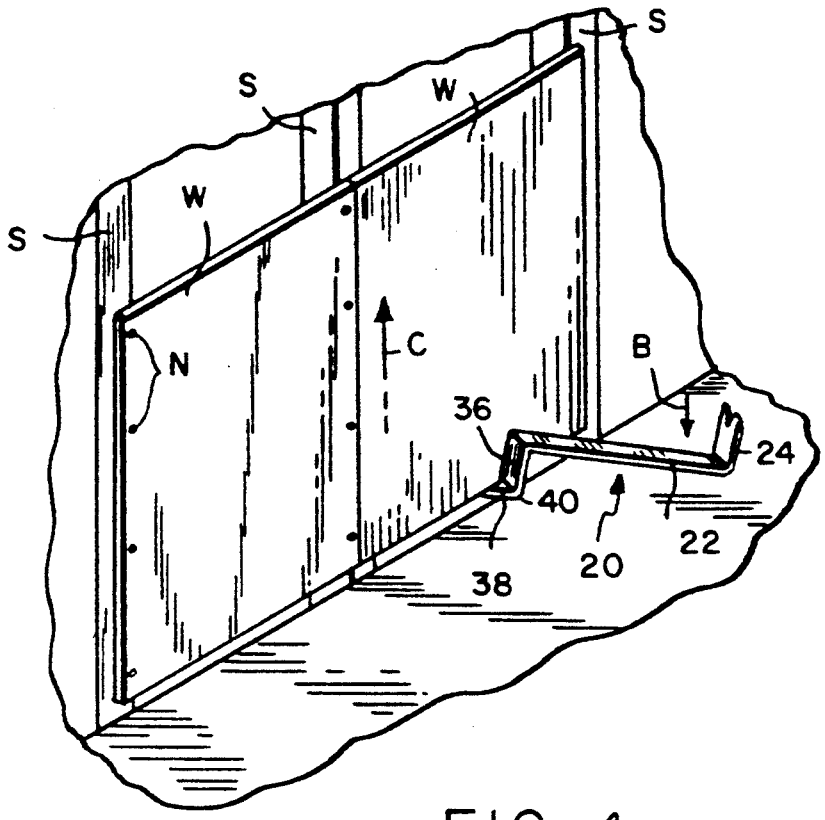

FIG. 4 illustrates how tool 20 may be used to lift up and position wall panels W against studs S to form a wall. In this case, the head 38 is the working end of the tool. That head is slid under a panel W and a downward force is applied to the body 22 of the tool at location B adjacent to foot 24. Due to the presence of the shoulder 36, the tool will pivot about the corner 40 thereby raising head 38 and the panel W supported thereby in the direction of arrow C in FIG. 4. In this way, the panel may be brought into alignment with another panel W already nailed to studs S. While holding tool 20 in the position shown in FIG. 4 with a foot, the worker can proceed to nail the supported panel W to the studs S.

Of course, the head end of the tool can also be used for prying and to remove nails at notch 42. Also, by holding the tool in both hands at foot 24 and shoulder 36, the head 38 can be thrust forward and upward to rip out shingles and shakes.

Because of the presence of the special shoulder 36, tool 20 can even be used as a chisel for splitting wood, stripping concrete forms, etc. In this application, the head edge **38*b* is positioned against the object to be split or between the objects to be pried apart and hammer blows are applied to shoulder 36 at corner 40 so that the head wedges down into the wood or between the objects to be pried apart. The long reverse bevel 38*a* that forms the edge 38*b*** enables the tool to gain entry between even the most tightly held-together objects.

It will be appreciated from the foregoing, then, that my tool is much more versatile than prior comparable utility bars of this general type. Yet, because it is formed from a single length of flat bar stock, the tool can be made relatively inexpensively. Therefore, it should find wide acceptance in the marketplace.

It will also be seen that the objects set forth above, among those made apparent from the preceding description, are efficiently attained and, since certain changes may be made in the above construction without departing from the scope of the invention, it is intended that all matter contained in the above description or shown in the accompanying drawing be interpreted as illustrative and not in a limiting sense.

It is also to be understood that the following claims are intended to cover all of the generic and specific features of the invention described herein.

I claim:

1. A tool comprising a single length of flat, rigid, steel bar stock having substantially uniform thickness and being bent in the nominal plane of the bar to provide an elongated body segment having opposite ends;

a foot segment extending at right angles from one end of the body segment;

a shoulder segment extending at right angles from the other end of the body segment in a direction opposite to that of the foot segment;

a head segment extending from the shoulder segment in a direction generally parallel to the body segment and away from the foot segment so that the head segment is offset from the body segment, said head and shoulder segments and said body and foot segments forming a pair of outside corner fulcrums on the same face of the tool, and a nail-pulling notch at the free end of at least one of said head and foot segments.

2. The tool defined in claim 1 wherein the free ends of said head and said foot segments have beveled edges on the same face of the tool that defines the outside corner fulcrums.

3. The tool defined in claim 1 wherein said body segment is at least three times longer than each of said shoulder and said foot segments.

4. The tool defined in claim 3 wherein said head segment is longer than each of said shoulder and said foot segments.

* * * * *